United States Patent [19]

Yu et al.

[11] Patent Number: 5,058,371

[45] Date of Patent: Oct. 22, 1991

[54] CONTINUOUS FILAMENT YARN FOR TRACKLESS CARPET

[75] Inventors: Jing-peir Yu, Pensacola, Fla.; Thomas C. Pursley, Loxley, Ala.; John H. Southern, Pensacola, Fla.

[73] Assignee: Monsanto Company, St. Louis, Mo.

[21] Appl. No.: 443,284

[22] Filed: Nov. 30, 1989

[51] Int. Cl.[5] ..... D02G 3/04; D02G 3/24

[52] U.S. Cl. ..... 57/239; 57/245

[58] Field of Search ..... 57/238, 239, 245, 244, 57/211

[56] References Cited

U.S. PATENT DOCUMENTS

| | | | |
|---|---|---|---|
| 2,199,429 | 5/1940 | Finlayson et al. | 57/239 X |
| 2,241,442 | 5/1941 | Bell et al. | 57/239 X |
| 2,575,753 | 11/1951 | Foster | 57/239 X |
| 3,199,281 | 8/1965 | Maerov et al. | 57/245 |
| 3,200,576 | 8/1965 | Maerov et al. | 57/245 |
| 3,225,534 | 12/1965 | Knospe | 57/245 |
| 3,416,302 | 12/1968 | Knospe | 57/245 |
| 3,444,681 | 5/1969 | Reese | 57/245 |
| 3,653,198 | 4/1972 | Hopkins | 57/239 X |
| 3,939,636 | 2/1976 | Nakayama et al. | 57/245 |
| 4,080,777 | 3/1978 | Griset | 57/239 X |
| 4,839,211 | 6/1989 | Wilkie et al. | 428/89 |
| 4,882,222 | 11/1989 | Talley et al. | 428/362 |

FOREIGN PATENT DOCUMENTS

| | | | |
|---|---|---|---|
| 112266 | 9/1979 | Japan | 57/239 |

*Primary Examiner*—Joseph J. Hail, III

*Attorney, Agent, or Firm*—John W. Whisler

[57] ABSTRACT

Yarn suitable for use in making cut pile trackless carpet is disclosed. The yarn is composed of two continuous filament singles yarn cabled together with from 3.5 to 5.0 turns per inch (2.54 cm) of twist. Each singles yarn is tangled and contains substantially no twist. The yarn is characterized, in that, each singles yarn comprises, in addition to crimped carpet filaments, filaments having no crimp and a high degree of shrinkage. The yarn develops texture during conventional heatsetting of the yarn without the use of mechanical crimping.

12 Claims, 1 Drawing Sheet

CONTINUOUS FILAMENT YARN FOR TRACKLESS CARPET

BACKGROUND OF THE INVENTION

This invention relates to novel continuous filament cabled yarn which after heatsetting is useful for making cut pile carpet which shows reduced foot traffic patterns, i.e., trackless carpet consists of two singles carpet yarns, both of which are tangled and contain substantially no twist (i.e. less than one turn of twist per 2.54 cm of singles yarn length) and. Presently, cabled continuous filament yarn that is used for making cut pile trackless carpet differs from that used for making saxony cut pile carpet in that it contains more cable twist and is textured in cabled yarn form. In commercial practice, the texturing of this yarn is accomplished by stuffer box and is coupled in-line with continuous heatsetting of the yarn using Superba ® heatsetting equipment and conditions. More specifically, the yarn is fed through a stuffer box crimper with or without steam to compress the yarn. The yarn upon exiting the crimper is permitted to fall onto the endless stainless steel, perforated belt of the Suberba heatsetting machine in a wadded up, crimped form. The belt passes slowly and continuously through a long chamber filled with saturated steam, which in the case of nylon yarn, is maintained at a temperature of about 136° C. The yarn, after passing through the chamber, is cooled in its wadded-up, crimped form and removed from the belt. The resulting textured yarn is ready for tufting of trackless carpet.

It would be highly desirable to reduce the cost of trackless carpet by providing a continuous filament cabled yarn which will develop texture during heatsetting without being first subjected to stuffer box crimping or other special mechanical crimping means.

SUMMARY OF THE INVENTION

In accordance with the present invention a continuous filament cabled yarn is provided which will develop texture during heatsetting of the yarn without first being subjected to stuffer box crimping or other special mechanical crimping means. The cabled yarn of the present invention differs from conventional continuous filament cabled carpet yarn in that the singles yarns in addition to containing crimped carpet filaments also contain high shrinkage filaments having no crimp and carpet filaments having crimp. The filaments are in the form of two singles yarns (plies) cabled together. The Shrinkage Value of the high shrinkage filaments is at least 5 units higher than the Contraction Value (i.e. the sum of the Bulk Value and Shrinkage Value) of the crimped carpet filaments. The Shrinkage Values and quantities of the high shrinkage filaments are selected such that after heatsetting of the cabled yarn the tracklessness of a cut pile test carpet having tufts made therefrom is better, as determined by Test A, hereinafter defined, than if the cabled yarn consisted entirely of the crimped carpet filaments. (The procedure for determining Shrinkage Values and Bulk Values are given hereinafter.) When the cabled yarn of the invention is subjected to heatsetting treatment, a torque is generated which imparts a random texture of the yarn that is desirable for trackless carpet constructions. The amount of texture imparted to the yarn is believed to be affected by the amount of high shrinkage filaments in the yarn and the difference between the Shrinkage Value of the high shrinkage filaments and the Contraction Value of the carpet filaments.

Figure 1:
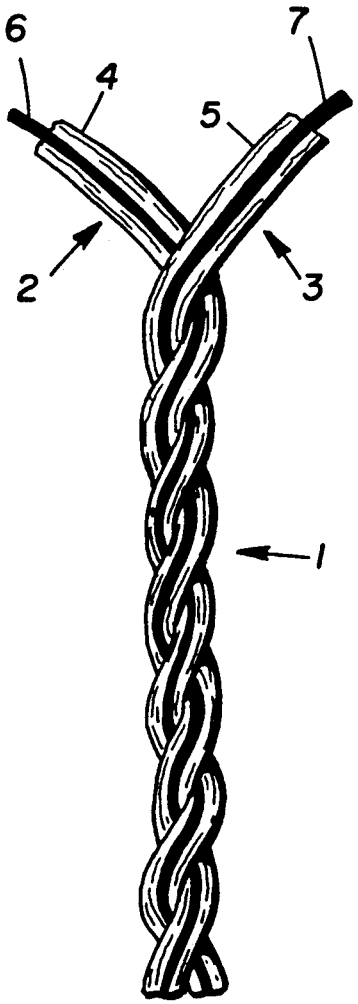
FIG. 1 is a schematic representation of a continuous filament yarn of the present invention. The yarn is composed of two single yarns, each consisting of high shrinkage filaments and carpet filaments, cabled together.

The invention will be understood from the following detailed description of the preferred embodiments.

DETAILED DESCRIPTION OF THE PREFERRED EMBODIMENTS

Crimped carpet filaments useful in making the plied yarn of the present invention have deniers of at least 10 (e.g. 12 to 25) and Shrinkage Values of less than 5. In present commercial practice, almost all continuous filament cabled yarns used in the construction of trackless carpets are composed of either crimped nylon 66 or crimped nylon 6 carpet filaments with the remainder of such cabled yarns being composed of crimped polypropylene carpet filaments. However, other crimped carpet filaments, such as, crimped polyester or acrylic carpet filaments are also contemplated as being useful in practicing the invention.

Normally, the Shrinkage Value of the crimped carpet filaments is 3 or less and the Bulk Value, for example, is about 17 but may be as high as 30 or more depending on the type of crimp imparted to the filaments, for example, conventional air jet texturing or gearcrimping methods provide filaments having a Bulk Value in the range of 15 to 22 while false twist texturing would provide higher Bulk Values.

The high shrinkage filaments of the cabled yarn have Shrinkage Values at least 5 units higher than the sum of the Bulk and Shrinkage Values of the crimped nylon carpet filaments. The denier of the high shrinkage filaments may be the same or different from that of the crimped carpet filaments. In general, as either the weight percentage or Shrinkage Value of the high shrinkage filament component of the cabled yarn increases while all other variables remain the same, more texture is imparted to the plied yarn. One or both plies of the plied yarn may contain high shrinkage filaments. Preferably, each ply contains the same amount by weight of the high shrinkage filaments. Representative high shrinkage filaments having the requisite Shrinkage Values include filaments made from polyester (e.g. polyethylene terephthalate); nylon copolymers, such as copolymers containing hexamethylene adipamide (66) units, hexamethylene terephthalamide (6TA) units and hexamethylene azelamide (69) units where the amounts are selected to provide a copolymer having a melting point approximately that of the crimped carpet filaments; and acrylic polymer. The cabled yarn of the invention usually contains from 4% to 30% by weight of the high shrinkage filaments, and, preferable, each singles yarn contain less than 25% by weight and most preferable less than 15% by weight of high shrinkage filaments.

Figure 2:
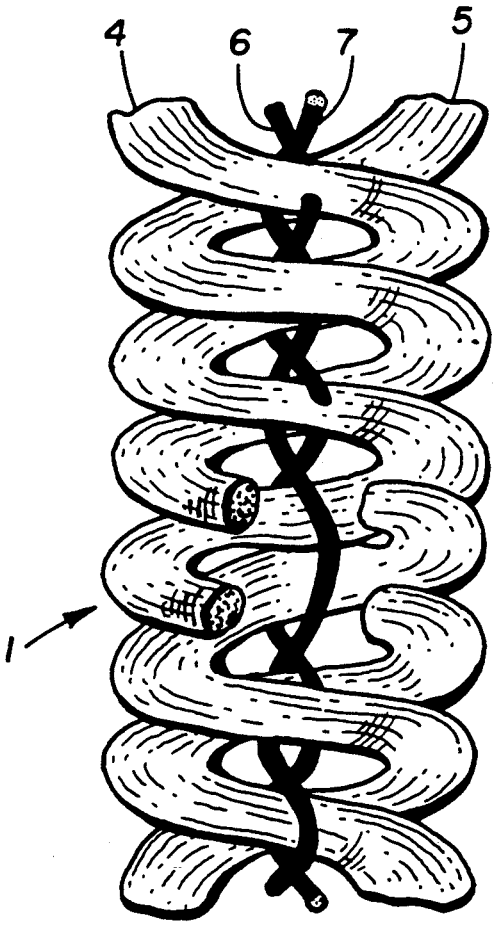
FIG. 2 is a schematic representation of the cabled yarn shown in FIG. 1 after the yarn is heatset with a portion broken away to show the arrangement of the high shrinkage and carpet filaments.
Figure 3:
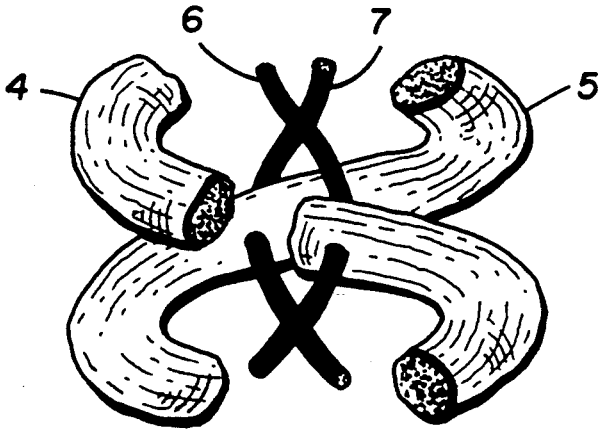
FIG. 3 is a schematic representation of a section of the cabled yarn shown in FIG. 2 with a portion broken away to show a slightly different arrangement of the filaments.

Referring to FIG. 1, where a preferred yarn of the present invention is illustrated, yarn 1 consists of two identical singles yarns 2 and 3 having little or no twist and being cabled together with, for example, 3.5 to 6.0 turns per inch (1.4 to 2.4 turns per cm) of twist. Yarns 2 and 3 are each conveniently prepared by inserting, respectively, bundles 6 and 7 of high shrinkage filaments (e.g. a 50 denier bundle consisting of 5 filaments) into conventional bulked (i.e. crimped) continuous filament singles carpet yarns 4 and 5 (e.g. 1250 denier yarn consisting of 60 filaments) by means of an air tangler. Yarn 1 is then heatset. During heatsetting of yarn 1, bundles 6 and 7 shrink causing yarns 4 and 5 to buckle as shown in FIGS. 2 and 3. Some breakage of high shrinkage acrylic filaments may occur by this method because the acrylic filaments are fragile. Of course, the high shrinkage filaments can be inserted into the singles carpet yarn by hand or other appropriate method if desired. Conventional bulked continuous filament nylon carpet yarns have a denier in the range of 1000 to 2000. In FIGS. 2 and 3 a portion of yarns 4 and 5 is broken away to expose filament bundles 6 and 7 which otherwise would be hidden.

High shrinkage filaments, such as polyester filaments, useful for practicing the present invention can be made by known techniques selected to provide the desired shrinkages. The plied yarns may also contain other components such as antistatic filaments and additives such as delustrants and antisoiling agents conventionally employed from time-to-time in the manufacture of carpet yarns.

According to one embodiment of the invention, special styling effects are achieved by subjecting yarns of the present invention to stuffer box crimping just prior to heatsetting. In this instance, while there is no cost advantage over conventional trackless cabled carpet yarns, there are aesthetic advantages that are not achievable with the conventional yarns.

MEASUREMENTS

Bulk and Shrinkage Values of filaments are determined by the following procedures. A yarn consisting of the filaments is conditioned at 23° C. and 72% relative humidity for one day prior to testing. Using a Suter denier reel or the equivalent and a winding tension of 0.033 grams per yarn denier, the yarn is wound into a skein having a 1.125 meter circumference and a skein denier of approximately (but not to exceed) 55,000 skein denier. For example, if the yarn denier is 520, 52 revolutions of the denier reel will provide a skein denier of 54,080 while 53 revolutions would provide a skein denier of 55,120. In this instance 52 revolutions Would be used. The ends of the skein are tied together While maintaining the 0.033 grams per denier tension, and the skein having a length of 56.25 cm is removed from the denier reel and suspended from a ½ inch (12.7 mm) diameter rod. A number 1 paper clip, bent into an "S" shape is suspended from the skein. The rod with skein and paper clip attached is placed in a 180° C. forced hot air oven sufficiently large that the skein hangs freely. (In the case of polypropylene, instead of using a temperature of 180° C., a temperature of 120° C. is used.) After 5 minutes in the oven, the rod with skein and paper clip is removed from the oven and hung in an atmosphere of 23° C. and 72% relative humidity for one minute. Then, a weight equal to 0.0009 grams per skein denier is then gently suspended from the paper clip and after an additional 30 seconds, the skein length in centimeters is again measured and recorded this time as L . The small weight is then replaced with a weight to give 0.0834 grams per skein denier and after an additional 30 seconds, the skein length in centimeters is once again measured, and recorded this time as $L_1$. The Bulk Value is determined by the following formula:

$$\text{Bulk Value} = \frac{56.25 - L_1}{56.25} \times 100$$

The Shrinkage Value is determined by the following formula:

$$\text{Shrinkage Value} = \frac{56.25 - L_2}{56.25} \times 100$$

The Contraction Value is the sum of the Bulk Value and Shrinkage Value.

TEST A

The following procedure provides a means for testing a cabled yarn (Test Yarn) comprising high shrinkage filaments and crimped nylon carpet filaments to determine if cut pile carpet having tufts made therefrom is better with respect to trackless than cabled yarn of comparable denier (Control Yarn) consisting entirely of the crimped nylon carpet filaments. By comparable denier is meant a denier that will permit the same gauge to be used in step (c) for both the Test and Control Yarns.

(1) A cabled yarn (Control Yarn) is made entirely of the crimped carpet filament present in the Test Yarn;

(2) The Test and Control Yarns are heatset using Superba® equipment in a conventional manner under conditions that are suitable for the carpet filaments of the yarn and that minimize restriction of the shrinkages of any of the filaments of the yarn.

(3) Two cut pile carpet samples of saxony construction are made. One of the samples (Control Carpet) is made using the Control Yarn and the other sample (Test Carpet) is made using the Test Yarn. Both carpet samples are made using the following construction:

(a) gauge (spacing between rows of tufts)—the choice of gauge depends on the denier of the single yarn defined as follows:

| Single Yarn Denier | Gauge |
|---|---|
| 800–999 | 1/10 |
| 1000–1299 | ⅛ |
| 1300–1499 | 5/32 |
| 1500 and higher | 3/16 |

(b) face weight—34 ounces (963.9 grams) of yarn per square yard of carpet with the spacings between stitches being selected to provide the 34 ounces (963.9 grams) face weight.

(c) pile height—⅝ inches (1.59 cm)

(d) backing—the primary backing is a polypropylene backing, such as Polybac® backing (style 2477) and the secondary backing is also a polypropylene backing, such as Actionbac® backing (style 3801).

4. The carpet samples are dyed to the same shade of color using conventional Otting dyeing equipment and dyeing conditions.

5. Each sample of carpet (Test Carpet and Control Carpet) is subjected to the following test procedure.
   (a) place the carpet samples side-by-side on a firm flat surface.
   (b) place a metal block (simulating a shoe) having a width of 6.35 cm, a length of 25.4 cm and a height of 3.81 cm on each carpet sample. Then, place sufficient weight on each block so that the total weight on each carpet sample is 22.7 kg.
   (c) after 15 seconds, remove the weights and the metal blocks from the carpet samples.
   (d) after an additional 90 seconds, visually compare the "foot prints" made in the carpets by the metal blocks and weights with the pile direction of both carpets being oriented in the same direction. The carpet having the least visually noticeable foot print has better tracklessness. If the foot prints appear visually the same, then the carpet samples have the same tracklessness.

The following example is given to further illustrate the invention. In the examples percentages are by weight.

EXAMPLE

A polyester (PET) 50 denier/5 filament yarn having a Shrinkage Value of 67 was inserted by air-jet into a bulked continuous filament 1250 denier/60 filament nylon 66 yarn having a Contraction Value of 20 to form a high shrink/carpet blend yarn. Two of the blend yarns were cabled with 3.5 turns per inch (2.54 cm) of twist in the S-direction to provide a cabled yarn. Two additional heatset cabled yarns were similarly made as described above except that instead of using the polyester yarn described above, a 50 denier-5 filament polyester yarn having a Shrinkage Value of 46 was used in making one of the yarns and a 108 denier-33 filament polyester yarn having a Shrinkage Value of 67 was used in making the other yarn. Also, a cabled yarn consisting entirely of above-mentioned nylon yarn was made (Control). Each yarn was heatset using Superba equipment and heatsetting conditions. Each cabled yarn was made into a trackless carpet and tested for tracklessness in accordance with Test A hereinbefore described. The results of Test A are given below.

TABLE

| Carpet | High Shrinkage Yarn | Tracklessness |
|---|---|---|
| 1 | None (Control) | Poor (None) |
| 2 | 50-5-PET (46% shrinkage) | Good |
| 3 | 50-5-PET (67% shrinkage) | Very Good |
| 4 | 108-33-PET (67% shrinkage) | Excellent |

The results given in the Table show that carpet having good tracklessness characteristics are provided with the cabled yarns containing either of the PET (67% shrinkage yarns). The results further show the effect of Shrinkage Value on tracklessness. (Compare the tracklessness of Carpet 2 and 3.) The tracklessness of Carpet 2 could be improved by inserting more of the PET (46% shrinkage) yarn into the cabled yarn.

In related experiments, the yarns instead of being heatset using Superba equipment and conditions were heatset using Suessen equipment and conditions. The results with regard to tracklessness were the same as given in the above Table.

In other related experiments, a 50 denier/5 filament polyester yarn having a Shrinkage Value of 67 was parallel fed into one of two 1250 denier-60 filament bulked continuous filament nylon 66 yarns (each having a Contraction Value of 20) during the cabling of the two nylon yarns. The yarns were cabled with 3.5 turns of twist per inch (2.54 cm) in the S-direction. In this instance, the cabled yarn contained polyester filaments in only one of the two plies. The cabled yarn after being heatset using Superba equipment and conditions was made into a trackless carpet and was tested for tracklessness as described above. The carpet was found to have good tracklessness characteristics.

It is expected that similar results will also be obtained when the cabled yarn of the invention comprises crimped carpet filaments other than crimped nylon carpet filaments, for example, crimped polypropylene carpet filaments.

We claim:

1. A yarn having a total denier in the range of 1000 to 2000 and consisting of two continuous filament singles yarns cabled together with from 3.5 to 6.0 turns of twist per inch (2.54 cm) of cabled yarn length, wherein each of said singles yarns is tangled, contains less than one turn of twist per inch (2.54 cm) of singles yarn length and comprises high shrinkage filaments having no crimp and carpet filaments having crimp and a denier per filament in the range of 10 to 25, wherein the Shrinkage Value of said high shrinkage filaments is at least 5 units higher than the Contraction Value of said rimped carpet filaments and wherein the Shrinkage Value and quantities of said high shrinkage filaments are selected such that after heatsetting of said cabled yarn the tracklessness of a cut pile test carpet having tufts made therefrom is better, as determined by Test A, than if the tufts were made entirely from said crimped carpet filaments.

2. The cabled yarn of claim 1, wherein said crimped carpet filaments are nylon filaments.

3. The cabled yarn of claim 2 wherein said nylon is nylon 66.

4. The cabled yarn of claim 3 wherein said high shrinkage filaments are polyester filaments.

5. The cabled yarn of claim 3, wherein the difference between the Shrinkage Value of said high shrinkage filaments and the Contraction Value of said carpet filaments is at least 15 units.

6. The cabled yarn of claim 3 wherein the difference between the Shrinkage Value of said high shrinkage filaments and the Contraction Value of said crimped carpet filaments is at least 10 units.

7. The cabled yarn of claim 1 wherein said crimped carpet filaments are polypropylene filaments.

8. The cabled yarn of claim 1 comprising from 4% to 30% by weight of said high shrinkage filaments.

9. The cabled yarn of claim 1 wherein each said singles yarn contains substantially the same amount, on a weight basis, of said high shrinkage fibers.

10. The cabled yarn of claim 9 wherein one of said singles yarns contains no high shrinkage filaments.

11. The cable yarn of claim 1 wherein each said singles yarn contains different amounts, on a weight basis, of said high shrinkage fibers.

12. The cabled yarn of claim 1 where less than 25% by weight thereof consists of said high shrinkage filaments.

* * * * *